US005614048A

United States Patent [19]

Barny et al.

[11] Patent Number: 5,614,048

[45] Date of Patent: Mar. 25, 1997

[54] MACHINE AND PROCESS FOR MAKING A SHEET OF SINGLE FACE CORRUGATED CARDBOARD

[75] Inventors: Jean-Jacques Barny, Villefranche; Jean-Marie Paultes, Perignac-de-Pons, both of France

[73] Assignee: OTOR, Paris, France

[21] Appl. No.: 403,748

[22] PCT Filed: Jul. 18, 1994

[86] PCT No.: PCT/FR94/00896

§ 371 Date: May 15, 1995

§ 102(e) Date: May 15, 1995

[87] PCT Pub. No.: WO95/03166

PCT Pub. Date: Feb. 2, 1995

[30] Foreign Application Priority Data

Jul. 20, 1993 [FR] France ..... 93 08909

[51] Int. Cl.[6] ..... B31F 1/28

[52] U.S. Cl. ..... 156/205; 156/210; 156/471; 156/472; 156/473

[58] Field of Search ..... 156/472, 473, 156/471, 470, 210, 205

[56] References Cited

U.S. PATENT DOCUMENTS

| | | | |
|---|---|---|---|
| 1,186,998 | 6/1916 | Langston | 156/472 |
| 1,199,508 | 9/1916 | Swift, Jr. | 156/205 |
| 3,811,987 | 5/1974 | Wilkinson et al. | 156/471 |
| 3,981,758 | 9/1976 | Thayer et al. | 156/64 |
| 4,086,116 | 4/1978 | Yazaki et al. | 156/205 |

FOREIGN PATENT DOCUMENTS

| | | | |
|---|---|---|---|
| 682805 | 12/1966 | Belgium . | |
| 0261246 | 3/1988 | European Pat. Off. . | |
| 0279609 | 8/1988 | European Pat. Off. . | |
| 536518 | 4/1993 | European Pat. Off. | 156/472 |

*Primary Examiner*—Michele K. Yoder

*Attorney, Agent, or Firm*—Merchant, Gould, Smith, Edell, Welter & Schmidt, P.A.

[57] ABSTRACT

A machine for manufacturing a sheet of corrugated board by gluing a fluted sheet of board onto a liner sheet of board includes: a fluted cylinder, a central fluted cylinder equipped with an assembly for applying the fluted sheet against its periphery, a smooth cylinder for bringing the liner sheet into contact with the crests of the flutes of the fluted sheet, and a motorized smooth heating cylinder situated downstream of a path of the corrugated board and entirely at distance from the first three cylinders; an assembly for controlling and adjusting the rotational speed of the motorized smooth heating cylinder; and an assembly for adjusting and maintaining during operation the pressure of the liner sheet on the flutes of the fluted sheet over a line of contact below 3 kg/cm. The fourth cylinder presses the fluted sheet onto the central fluted cylinder over an circular arc corresponding to a subtended angle between an order of 30° and an order of 80°. The fourth cylinder contacts with the back of the liner sheet over an circular arc corresponding to a subtended angle between an order of 90° and an order of 200°.

12 Claims, 2 Drawing Sheets

MACHINE AND PROCESS FOR MAKING A SHEET OF SINGLE FACE CORRUGATED CARDBOARD

FIELD OF THE INVENTION

The present invention relates to the manufacture of corrugated board and more particularly to a machine for manufacturing a sheet of single face corrugated board by glueing a fluted sheet of board onto a flat sheet of board, termed liner sheet, of the type comprising three heating cylinders which are substantially tangential in pairs, with parallel axes, namely a first fluted cylinder for preforming the fluted sheet, a second, central, fluted cylinder associated with means for applying the fluted sheet against its periphery, and a third, smooth, cylinder for bringing the flat sheet into contact with the flutes of the fluted sheet at the periphery of the second cylinder, as well as means for coating the said flutes with glue before the contact between fluted sheet and liner sheet.

It also relates to a process for manufacturing sheets of single face corrugated board, particularly using a machine of the above type.

It finds a particularly important, although not exclusive, application in the field of the manufacture of single face sheets at high speed using board obtained from low grammage (less than of the order of 150 g/m$^2$) recycled paper.

DESCRIPTION OF THE PRIOR ART

Machines of the above-defined type are already known.

FIG. 1 thus represents a machine 1 of the prior art in a line 2 for manufacturing single face corrugated board.

The line comprises means 3 and 4 respectively for feeding flat, liner sheet and flat sheet which is intended to form the fluted sheet.

These feed means comprise, in a way which is itself known, reel unwind stands 5 which allow good control of the unwinding and of the braking which are necessary for the manufacture of the board.

They also comprise a preheater 6 for the liner sheet, generally consisting of a steel cylinder heated by steam and equipped with small rolls termed "turn rolls" which serve to vary the paper/cylinder contact area, and a preconditioner 7 for the fluted sheet, which for its part and furthermore includes a boom for moistening the sheet, which promotes the formation of the flutes.

The line 2 moreover comprises means 8 for discharging the single face board obtained, these means consisting of a system of belts at the top part of the line.

FIG. 2 shows more precisely, in a sectional view, the single face machine 1 of the line of FIG. 1.

It comprises, on the fluted sheet feed side, an additional preheating cylinder 9 and a moistening cylinder 10 and, on the liner sheet feed side, two rotating preheating cylinders 11.

The machine 1 moreover comprises a first, top, fluted cylinder 12 made of stainless steel. It is hollow and designed to be heated with steam in a way which is itself known.

The machine 1 also comprises a second, central, fluted cylinder 13 made of stainless steel of axis parallel to that of the first cylinder substantially tangential to the latter and, for example, of the same diameter.

The second cylinder is, for example, of the type known under the name "Air Drive", manufactured by the French company MARTIN.

It includes two chambers, namely a central steam-heated chamber and a vacuum chamber 15 connected to a device 16 for forming a vacuum. The chamber comprises ducts 17 pierced along the entire length of the cylinder and communicates with the fluted peripheral surface via holes.

The machine 1 comprises a third, bottom, cylinder 18 with a smooth surface, of axis parallel to the first two and, for example, of the same diameter. This cylinder is heated with steam in a similar way to the first two and is designed to compress the liner sheet against the crests of the flutes of the fluted sheet, in contact with the periphery of the central fluted cylinder, as will be seen.

The machine 1 moreover comprises means 19 for coating the crests of the flutes with glue, these means being in themselves known, and comprising a laminating roll 20, a bath of glue 21 and a glueing roll 22.

The operating principle of the machine 1 is as follows.

Two sheets or webs of paper in board 23 and 24 are introduced into the machine 1.

The sheet 23 is intended to form the fluted sheet.

After a drying and moistening treatment at 7, 9 and 10 it passes around the first fluted heating cylinder 12, over a part of its periphery.

It is then introduced between the two fluted heating cylinders 12 and 13 which rotate in opposite directions from one another, like two gearing cylinders.

The vacuum created in the lower part of the cylinder 13 then presses the fluted sheet 23 formed against the heating cylinder of a circular arc having a vertex angle equal to of the order of 180°.

When it passes over the face of the glueing roller 22, a line of glue is, moreover, and as has been seen, deposited at the crest of the flutes.

The glue is, for example, based on starch.

The liner sheet 24 is, for its part, introduced at the bottom and on the opposite side of the machine 1.

It is predried at 11 and wound around the third cylinder 18, which is also called a smooth press cylinder. A very strong hydraulic pressure, for example of 5 kg/cm (line pressure) ensures successive contact at 25 (see FIG. 3) between each top crest of the flutes of the fluted sheet 23 and the liner sheet 24 made of smooth paper.

The glue joint is thus obtained through the combined action of the high pressure and of the temperature in a fraction of a second.

Entrainment of the sheets is achieved by traction, the fluted sheet being entrained by the meshing of the fluted cylinders 12 and 13, and the liner sheet being entrained by being trapped between the central cylinder 13 and the smooth cylinder 18.

Other types of single face machines exist, such as those in which the fluted sheet is pressed onto the central cylinder by air, instead of being sucked on by vacuum, for example.

Their operating principle and the structural elements which they employ in general, however, remain identical to those described hereinabove.

Although they allow high throughput rates to be achieved, giving an acceptable single face paper, the known machines do, however, still exhibit drawbacks.

In particular, in order to obtain good glueing, which is the desired objective if a good quality corrugated board is desired, it was hitherto believed that it was necessary to press the two sheets one on the other with very high pressure, it being moreover understood that a sufficient temperature is maintained at the moment of glueing to allow the glue to gelatinize.

Unfortunately, and in particular, this pressure gives rise to troublesome effects.

It is in fact applied to the top part of the crests of the flutes (see FIG. 3) which causes the board to be cut, especially at resonant speeds, or alternately at high speeds.

Furthermore, since the pressing cylinder 18 is applied against the central fluted cylinder 13 discontinuously, from one flute to another, vibrations and significant noise (105 to 110 decibels at high speed) are generated.

This results in a poor quality corrugated board, in which the characteristics of moisture-resistance and burst strength of the liner sheet, for example, are lessened.

SUMMARY OF THE INVENTION

The present invention aims to provide a machine and a process for manufacturing single face corrugated board which meets the practical requirements better than those known before, especially in that it makes it possible to practically eliminate cuts of paper at resonant speeds and/or at high speed, that is to say for example speeds of above 300 m/min, and in that it makes it possible to obtain excellent glueing, which produces a corrugated board of improved performance and does so for low cost and in a way which is easy to implement.

The existing machines may, moreover, easily be adapted to profit from the improvement that the present invention constitutes.

In order to do this, the present invention starts off from an entirely new idea consisting especially in considerably reducing the pressure, or even eliminating it completely, between the fluted cylinder 12 and the smooth cylinder 18 on the surface for contact between the sheets, and does so in complete contrast to the teachings of the prior art, replacing the high pressure by prolonged heating of the sheets against each other.

To this end, the present invention particularly proposes a machine for manufacturing a sheet of single face corrugated board by glueing a fluted sheet of board onto a flat sheet of board, comprising three heating cylinders which are substantially tangential in pairs, with parallel axes, namely a first fluted cylinder for preforming the fluted sheet, a second, central, fluted cylinder associated with means for applying the fluted sheet against its periphery, and a third, smooth, cylinder for bringing the flat sheet into contact with the flutes of the fluted sheet at the periphery of the said second cylinder, and means for coating the said flutes with glue before the said contact, characterized in that it additionally includes a fourth, smooth, rotary, heating cylinder of axis parallel to the other cylinders, situated downstream of the path of the corrugated board with respect to the said other cylinders and designed to press the fluted sheet onto the second cylinder over a circular arc corresponding to a subtended angle of a first given value, and to be itself in contact with the back of the flat sheet over a circular arc corresponding to a subtended angle of a second given value.

Advantageously, means for controlling and adjusting the rotational speed of the said fourth cylinder with respect to the rotational speed of the said second cylinder (or, which is the equivalent, to the speed of travel of the corrugated board) are moreover provided.

In advantageous embodiments, recourse is additionally had to one and/or other of the following provisions:

- the first given value is between of the order of 30° and of the order of 80°;
- the first value is of the order of 60°;
- the second given value is between of the order of 90° and of the order of 200°;
- the second given value is of the order of 180°;
- the fourth heating cylinder has the same diameter as the first three heating cylinders;
- the machine additionally includes a small smooth cylinder of axis parallel to the axis of the said heating cylinders, situated downstream of the said cylinders in the path of the corrugated board and beneath the horizontal plane tangential to the upper generatrix of the fourth cylinder;
- the machine includes means for adjusting pressure of the liner sheet on the flutes of the corrugated sheet, below a given threshold value Po, for example of the order of 3 kg/cm ($0 \leqq Po < 3$ kg/cm);
- the machine includes means for maintaining the distance between the surfaces of the second and third cylinders which are designed to eliminate any pressure of the third cylinder on the fluted and liner sheets of the corrugated sheet in contact with the second cylinder.

Such a system in fact gives excellent results even at speeds of progression of the board of 200 m/min.

The invention also proposes a manufacturing process using a machine as described hereinabove, and more particularly a process for manufacturing a sheet of single face corrugated board, starting from a sheet of fluted board and from a flat sheet of board, termed liner sheet, by glueing one onto the other, characterized in that the crests of the flutes of the corrugated sheet which have been coated with glue beforehand are kept in contact with the flat sheet over a first zone formed by a first surface portion of a heating central fluted cylinder designed to press the said fluted sheet against the said first surface portion, over an arc corresponding to a subtended angle of a first given value, and over a second zone formed by a second surface portion of a rotary heating smooth cylinder situated downstream of the path of the corrugated board with respect to the central cylinder, designed to press the said liner sheet against the said second surface portion over an arc corresponding to a subtended angle of a second given value.

In advantageous embodiments, recourse is additionally had to one and/or other of the following provisions:

- the first given value is between of the order of 30° and of the order of 80°;
- the first given value is of the order of 60°;
- the second given value is between of the order of 90° and of the order of 200°;
- the second given value is of the order of 180°
- the speed of the heating smooth cylinder is set to a speed of between of the order of 1.02 V and of the order of 1.25 V, advantageously 1.06 V, V being the speed of travel of the corrugated board formed;
- a pressure is applied between the flute crests and the liner sheet at the first point of contact after glueing, the value of this pressure being less than 3 kg/cm;
- no pressure is applied by the third cylinder to the fluted and liner sheets of the corrugated sheet in contact with the second cylinder (zero line pressure).

The invention will be better understood from reading the description of one embodiment of the invention which is given hereinafter by way of nonlimiting example.

BRIEF DESCRIPTION OF THE DRAWINGS

The description refers to the accompanying drawings in which, in addition to FIGS. 1 to 3 which have already been described relating to a machine of the prior art.

DETAILED DESCRIPTION OF THE PREFERRED EMBODIMENT

Figure 4:
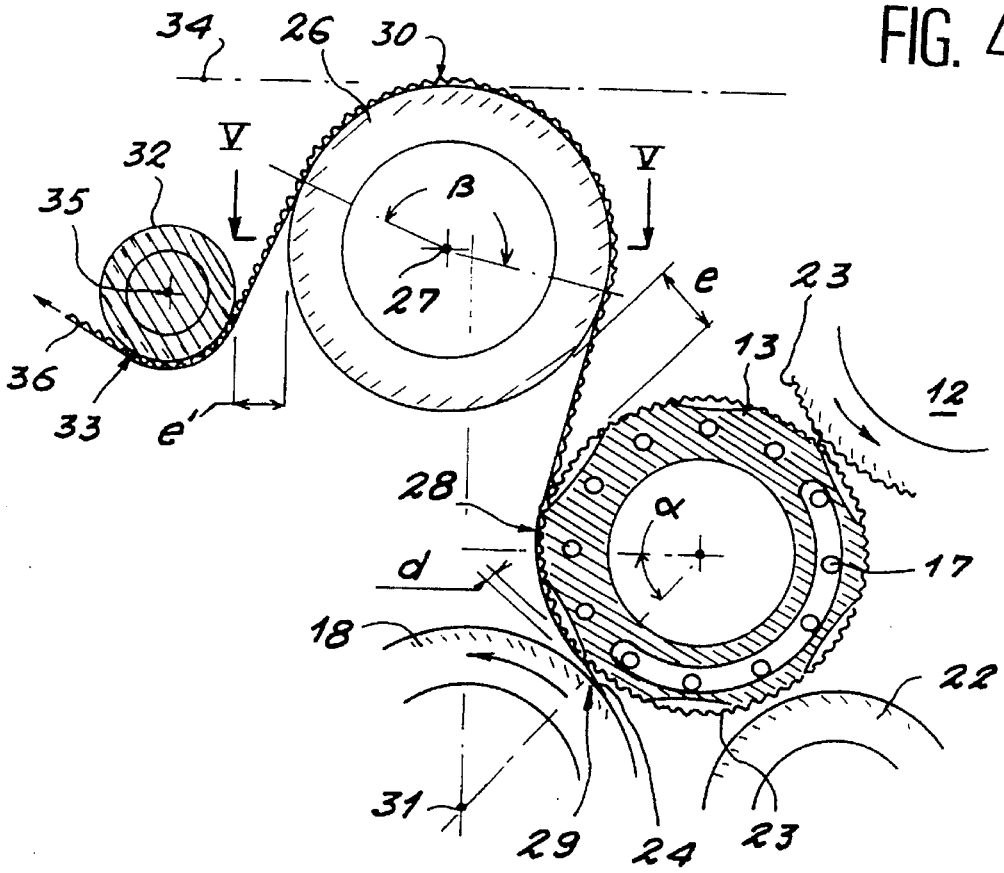
FIG. 4 diagrammatically shows one embodiment of the improvement that the invention constitutes, in transverse section.

The machine according to the embodiment of the invention more particularly described here on the one hand comprises a single face machine of the type described with reference to FIG. 2 and, on the other hand, comprises a fourth cylinder set out as will be described hereinbelow with reference to FIG. 4.

In order to simplify, the same reference numerals are used when they denote the same elements.

In addition to the first, second and third cylinders 12, 13 and 18 described with reference to FIG. 2, the machine according to the invention includes a fourth, heating, smooth cylinder 26 of axis 27 parallel to the axes of the previous cylinders and situated above these, for example directly after the second cylinder in the path of the sheet of corrugated board.

This cylinder is heated with steam in a similar way, for example to reach an outer surface temperature of the cylinder of between 160° C. and 200° C.

It is made of a stainless steel and, for example, has an identical diameter to the others.

Means (not represented) for adjusting the rotational speed of the cylinder 26, which means are known in themselves, are provided. The ratio of speeds of the cylinder 26 and of the travel of the board can

12 therefore be adjusted to provide tension in the liner sheet which is wound over and in contact with the smooth surface of the cylinder.

With a machine thus modified, glueing is different from conventional glueing. Instead of making the glued joint instantaneously through the combined action of the heat and of a high pressure, glueing is ensured essentially by the heat, the pressure being substantially reduced.

The glue is dried in two zones:

a first zone 28 of contact between the fluted sheet 23 and liner sheet 24, where the two sheets are held one against the other on the central fluted cylinder 13 over a wound angle α, for example of approximately 60°.

At the point 29 where the two sheets are joined together, the space between the central fluted cylinder 13 and the smooth third press cylinder 18 is moreover maintained at a fixed value by adjustable limit stops so that the pressure is zero or low, for example lying between 0 and 3 kg/cm, and does not damage the sheets;

a second contact zone 30, where the two sheets are again held one against the other but this time on the cylinder 26 over a winding angle β, for example of 180°, which makes it possible to complete gelatinization and drying of the glue.

Advantageously, if V is the speed of travel of the board, and V1 is the external speed of the cylinder 26, V1 [sic] is between of the order of 1.02 V and of the order of 1.25 V.

In the embodiment more particularly described here, and in order to keep the sheet of corrugated board on the fluted side in contact with the fluted surface of the cylinder 13 over an angle α, the cylinder 26, at least with respect to the plane tangential to the point of contact 29 with the cylinder 13, has a part of its surface on the same side as the said cylinder 13.

In order to do this, the axis 27 of the cylinder 26 may also be situated on the same side (not represented on FIG. 4, which shows an alternative on the opposite side) as the cylinder 13, with respect to the vertical plane passing through the axis 31 of the smooth cylinder 18.

In order to keep the sheet of corrugated board, on the smooth side, in contact with the cylinder 26 over an angle β, a small smooth and solid roll 32, known in itself, and able to be in contact with the sheet of corrugated board, on the corrugated side, is, for example, provided.

In order to do this, it has, for example, a lower generatrix 33 situated beneath the horizontal plane 34 tangential to the upper generatrix of the cylinder 26.

Advantageously the axis 35 of the cylinder 32 is situated beneath the axis 27 of the cylinder 26.

Sufficient distances e and e' between side walls, respectively of the cylinders 13 and 26 and 26 and 32, are moreover provided in order to allow the sheet of board 36 formed to progress correctly.

Figure 5:
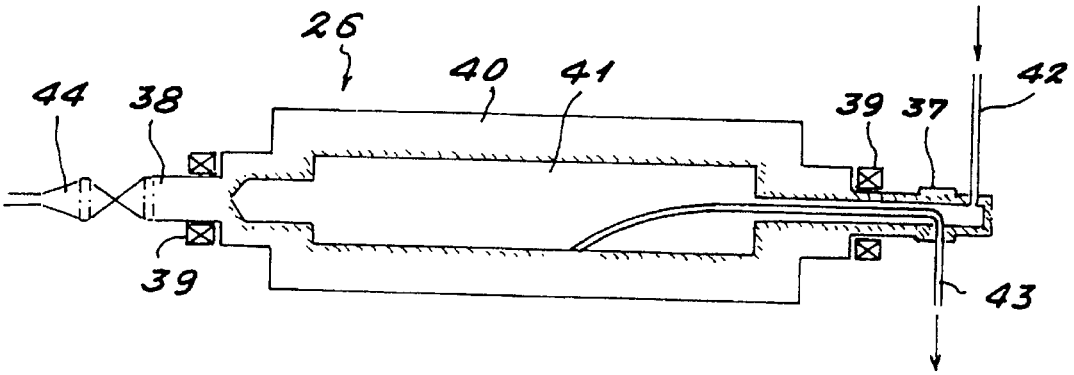
FIG. 5 is a diagrammatic section on V—V of the fourth cylinder of FIG. 4.

FIG. 5 shows a diagrammatic section on V—V of the cylinder 26.

It comprises two cylindrical ends 37 and 38 mounted on bearings 39 and a cylindrical body 40, for example made of stainless steel or cast iron, equipped with a central recess 41 fed with steam at 42 via the end 37.

The steam circulates inside the recess and is discharged at 43 via the same end 37. A variable-speed motor 44 makes it possible to vary the rotational speed of the cylinder 26 in a way which is known in itself, as a function of the desired tension for the corrugated board.

The smooth surface of the cylinder 26 allows possible sliding, allowing slippage which takes up any possible play.

By virtue of the invention, a significant improvement in characteristics of the single face corrugated board produced has been observed.

Figure 1:
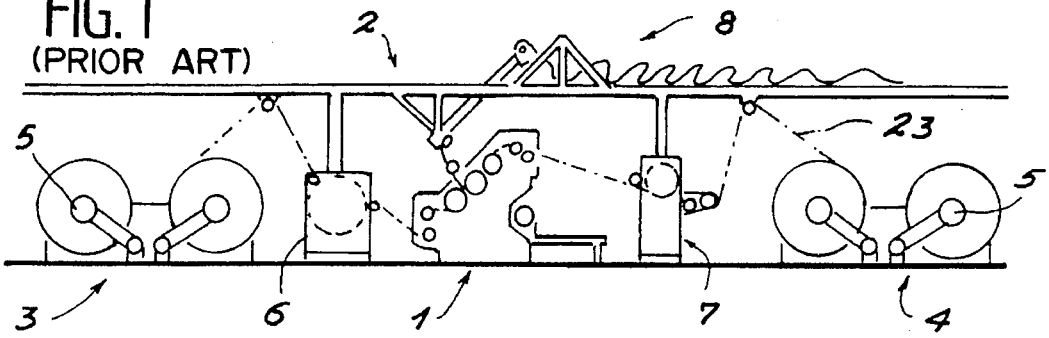
FIG. 1 (PRIOR ART)
Figure 2:
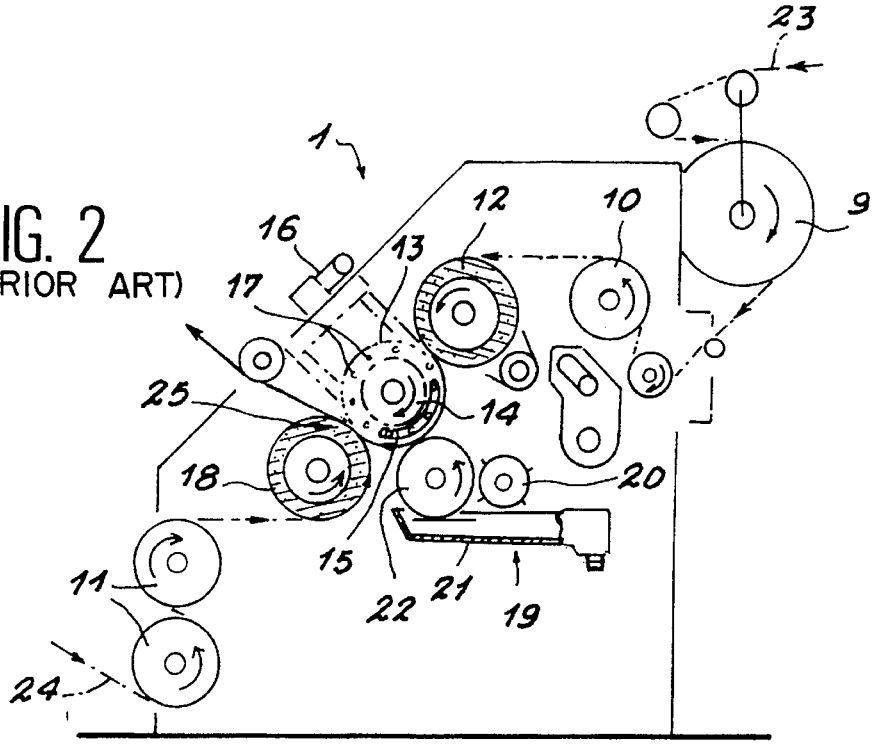
FIG. 2 (PRIOR ART)
Figure 3:
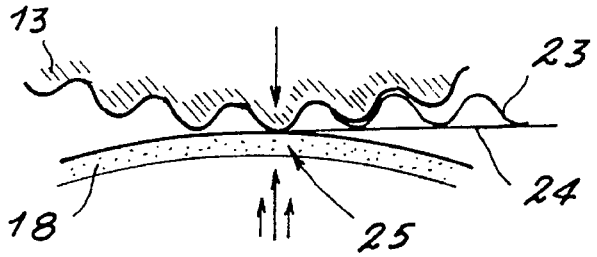
FIG. 3 (PRIOR ART)

In particular, and for example, with all other things moreover being equal, an improvement at least of the order of 20% in the Cobb moisture resistance was observed, and a 10% improvement in the burst strength of the liner was observed, by comparison with a machine of the type of that of FIG. 2.

More generally, a device according to the invention preserves the Cobb moisture resistance qualities of the liner paper, without detrimental change, contrary to that which is observed with the devices of the prior art.

We claim:

1. Machine for manufacturing a sheet of single face corrugated board by gluing a fluted sheet of board onto a liner sheet of board, with a preset speed of travel of said corrugated board, the machine comprising;

three heating cylinders which are substantially tangential in pairs, with parallel axis, being a first fluted cylinder for performing flutes of the fluted sheet in which said flutes having crests, a second, central, fluted cylinder equipped with means for applying the fluted sheet against the periphery of the second cylinder, and a third, smooth, cylinder for bringing the liner sheet into contact with the crests of said flutes of the fluted sheet, under a pressure and over a line of contact parallel to said axis situated at the periphery of said second cylinder;

means for coating the crests of said flutes with glue before said line of contact;

a fourth, motorized, smooth, heating cylinder a axis parallel to said three heating cylinders, situated downstream of a path of the corrugated board with respect to said three heating cylinders, entirely at distance from said three cylinders, said fourth cylinder having an adjustable rotational speed and being designed to press the fluted sheet onto the second cylinder over a first circular arc corresponding to a first subtended angle of a first given value comprised between of an order of 30° and of an order of 80°, and said fourth cylinder being in contact with a back of the liner sheet over a second circular arc corresponding to a second subtended angle of a second given value comprised between of an order of 90° and of an order of 200°;

means for controlling and adjusting said rotational speed of said fourth cylinder with respect to the preset speed of travel of the corrugated board; and means for adjusting and maintaining during operation, the pressure of the liner sheet on the flutes of the fluted sheet over said line of contact by the third cylinder, below a given threshold value of 3 kg/cm.

2. Machine according to claim 1, wherein the first given value is of an order of 60°.

3. Machine according to claim 1, wherein the second given value is of an order of 180°.

4. Machine according to claim 1, wherein the fourth heating cylinder has a same diameter as the first three heating cylinders.

5. Machine according to claim 1, further comprising a fifth, smooth cylinder having axis parallel to the axis of the first four cylinders, situated downstream of the first four cylinders in the path of the corrugated board and beneath a horizontal plane tangential to an upper generatrix of the fourth cylinder.

6. Machine according to claim 1, further comprising means for maintaining the distance between surfaces of the second and third cylinders, which are designed to eliminate any pressure of the third cylinder on the fluted and flat sheets of the corrugated sheet in contact with the second cylinder.

7. Process for manufacturing a sheet of single face corrugated board with a preset speed of travel of said corrugated board, comprising the steps of:

feeding a sheet of board material between first and second heating corrugated cylinders to form a fluted board around said second heating corrugated cylinder, said second heating corrugated cylinder having an axis, said fluted board having parallel flutes presenting parallel crests to said axis of the second cylinder;

coating the crests of said flutes with glue;

bringing into contact a liner sheet, which is supplied by a third heating cylinder, with said crests over a line of contact parallel to said axis of the second cylinder;

applying and maintaining during operation a pressure on said crests by said third heating cylinder, over said line of contact, of a value less than 3 kg/cm;

keeping the fluted board, after said line of contact, in contact with the liner sheet over a first zone formed by a first surface portion of said second cylinder, over a first arc corresponding to a first subtended angle of a first given value comprised between of an order of 30° and of an order of 80°; and further keeping said timed board in contact with said liner sheet over a second zone formed by a second surface portion of a rotary heating smooth fourth cylinder situated distantly apart from the second cylinder and downstream of a path of the fluted board with respect to the second cylinder, said fourth cylinder having a rotational speed and being arranged to have said liner sheet pressed against the surface portion over a second arc corresponding to a second subtended angle of a second given value comprised between of an order of 90° and of an order of 200°.

8. Process according to claim 7, wherein the first given value is of an order of 60°.

9. Process according to claim 7, wherein the second given value is of an order of 180°.

10. Process according to claim 7, wherein the rotational speed of the fourth cylinder is set to a speed of between an order of 1.02 V and an order of 1.25 V, V being the preset speed of travel of the corrugated board.

11. Process according to claim 7, wherein a speed of the third cylinder is of an order of 1.06 V, V being the preset speed of travel of the corrugated board.

12. Process according to claim 7, wherein the value of the pressure applied by the third heating cylinder on said crests over said line of contact, during operation is 0 kg/cm.

* * * * *

UNITED STATES PATENT AND TRADEMARK OFFICE
CERTIFICATE OF CORRECTION

PATENT NO. : 5,614,048

DATED : March 25, 1997

INVENTOR(S) : Barny et al.

It is certified that error appears in the above-identified patent and that said Letters Patent is hereby corrected as shown below:

Col. 4, line 16: insert --the-- after the word "adjusting"

Col. 5, lines 39-40: delete "12"; "therefore" should not start a new paragraph.

Signed and Sealed this

Second Day of December, 1997

*Attest:*

Bruce Lehman

BRUCE LEHMAN

*Attesting Officer*

*Commissioner of Patents and Trademarks*